US007540753B2

(12) United States Patent
Dobler

(10) Patent No.: US 7,540,753 B2
(45) Date of Patent: Jun. 2, 2009

(54) ELECTRIC SOCKET

(75) Inventor: Oliver Dobler, Tschagguns (AT)

(73) Assignee: Neutrik Aktiengesellschaft (LI)

( * ) Notice: Subject to any disclaimer, the term of this patent is extended or adjusted under 35 U.S.C. 154(b) by 0 days.

(21) Appl. No.: 12/168,941

(22) Filed: Jul. 8, 2008

(65) Prior Publication Data

US 2008/0268692 A1 Oct. 30, 2008

(30) Foreign Application Priority Data

Jan. 11, 2006 (DE) ..... 10 2006 001 630
Jan. 10, 2007 (WO) ..... PCT/AT2007/000004

(51) Int. Cl.
*H01R 13/625* (2006.01)

(52) U.S. Cl. ..... 439/346

(58) Field of Classification Search ..... 439/346, 439/352, 595

See application file for complete search history.

(56) References Cited

U.S. PATENT DOCUMENTS

| | | | | |
|---|---|---|---|---|
| 4,630,876 | A * | 12/1986 | Grunberg et al. | 439/350 |
| 5,149,283 | A * | 9/1992 | Nakazawa | 439/607 |
| 5,702,264 | A | 12/1997 | Endo et al. | |
| 6,548,761 | B1 * | 4/2003 | Wang | 174/93 |
| 6,648,674 | B1 * | 11/2003 | Dobler | 439/460 |
| 6,692,287 | B2 | 2/2004 | Yasuda | |
| 7,182,615 | B1 * | 2/2007 | Liu | 439/263 |
| 2006/0205261 | A1 * | 9/2006 | Burton | 439/346 |

FOREIGN PATENT DOCUMENTS

| | | | |
|---|---|---|---|
| AT | 399427 | B | 5/1995 |
| EP | 1128485 | A1 | 8/2001 |
| EP | 1318574 | A2 | 11/2003 |
| EP | 1503463 | A1 | 2/2005 |
| WO | WO 92/08259 | | 5/1992 |
| WO | WO 2007/079513 | A1 | 7/2007 |

* cited by examiner

*Primary Examiner*—Briggitte R Hammond
(74) *Attorney, Agent, or Firm*—Neal L. Slifkin

(57) ABSTRACT

Socket for alternatively creating an electrical plug-in connection having a first plug (1), especially in the form of an XLR plug, or having a second plug constructed in the form of a jack connector (7), whereby the socket comprises a locking arm (22) with a locking protrusion (23) that engages, in the plugged-in state of the first plug (1), into a locking recession (6) in the plug housing (5) of the first plug (1), and an actuation unit (24), that in an active position keeps the locking protrusion (23) disengaged from the locking recession (6) of the first plug (1). The socket also has a locking device for the jack connector (7) that comprises a locking extension (37) that in the plugged-in state of the jack connector (7) engages in a constriction (12) of the contact tip (10) of the jack connector (7), and a blocking part (38) that has a contact surface (39) that in a blocking position of the blocking part (38) rests against an opposite contact surface (40) of the socket. By means of the actuation unit (24), a section of the blocking part (38) adjoining the contact surface (39) can be displaced in the plug-in direction (14) and the contact surface (39) of the blocking part (38) can be made to disengage from the opposite contact surface.

15 Claims, 4 Drawing Sheets

7
7
7
28
29
24
30
38
37
10
44
12
20
11
14
40
39
41
38
37
28
26
25
29
30
39
38
20

ELECTRIC SOCKET

BACKGROUND OF THE INVENTION

1. Field of the Invention

The invention relates to a socket for alternatively creating an electrical plug-in connection having a first plug that on a plug-in side end has several contact pins and, surrounding these, a sleeve-shaped section of a plug housing with a locking recession, or a having a second plug constructed in the form of a jack connector that has a plug shaft with a contact sleeve and a contact tip, whereby the first plug and the jack connector can be plugged in a plug-in direction into the socket and whereby the socket comprises a locking arm with a locking protrusion that, in the plugged-in state of the first plug, engages in the locking recess in the plug housing of the first plug, and an actuation unit that, based on a passive position, can be displaced in the plug-in direction to an active position, and in the active position, it acts on the locking arm and disengages the locking protrusion from the locking recession of the first plug.

2. Description of Related Prior Art

Such sockets are known. The socket has on the one hand electrical contact elements to create an electrical plug contact with a first plug that possesses multiple electrical contact elements in the form of plug pins, and in particular is constructed in the form of an XLR plug. Such XLR plugs are particularly widespread for audio applications and standardized accordingly. On the other, the socket has corresponding electrical contact elements to create an electrical plug contact with a jack connector. A jack connector has a plug shaft with a contact sleeve that constitutes the electrical contact element of the jack connector, and a contact tip electrically insulated from it that also constitutes one of the electrical contact elements of the jack connector. Moreover, the jack connector can have between the contact sleeve and the contact tip an electrical contact ring that constitutes an additional electrical contact element of the jack connector. To allow plugging in either the XLR plug or jack connector, the socket has a corresponding plug-in opening.

Conventional sockets of this type have a lock for the XLR plug as is common in XLR plug contacts to secure the XLR plug from being pulled out unintentionally. However, the jack connector inserted into the socket only snapped into place by a spring-elastic element that engages in a constriction of the contact tip. By pulling on the cable, the jack connector can be partially or entirely pulled out of the socket with a corresponding interruption of the electrical contacts.

OBJECT AND SUMMARY OF THE INVENTION

The object of the invention is to provide an improved socket of the type mentioned in the introduction, in which contact reliability is increased for a plugged-in jack connector. According to the invention, this is achieved by a socket for alternatively creating an electrical plug-in connection with a first plug that on a plug-in side end has several contact pins and, surrounding these, a sleeve-shaped section of a plug housing with a locking recession, or a second plug constructed in the form of a jack connector that has a plug shaft with a contact sleeve and a contact tip, whereby the first plug and the jack connector can be plugged in a plug-in direction into the socket, the socket comprising a locking arm with a locking protrusion that, in the plugged-in state of the first plug, engages in the locking recession in the plug housing of the first plug to lock in the first plug, an actuation unit that, based on a passive position, can be displaced in the plug-in direction to an active position and in the active position acts on the locking arm and disengages the locking protrusion from the locking recession of the first plug, and a locking device for the jack connector, which comprises a locking extension that, in the plugged-in state of the jack connector, engages in the constriction of the contact tip of the jack connector, and a blocking part that has a contact surface, which, when the blocking part is in a blocking position, rests against an opposite contact surface of the socket, whereby, when the blocking part is in a blocking position, the blocking part holds the locking extension engaged in the constriction of the contact tip of the jack connector and is blocked from being pushed out of the constriction, and which, by means of a displacement of at least one of the blocking part's sections adjoining the contact surface, can be brought to disengage in the plug-in direction from the opposite contact surface, whereby a pushing out of the locking extension from the constriction of the contact tip of the jack connector is enabled, whereby the actuation unit in its displacement from its passive position to its active position displaces at least one of the blocking part's sections adjoining the contact surface in the plug-in direction and disengages the contact surface of the blocking part from the opposite contact surface.

An electrical socket according to the invention thus also has a locking device for the jack connector, whereby a locking extension of the electrical socket, in the plugged-in state of the jack connector, engages in a constriction of the contact tip and, even when pulling on the jack connector, is blocked by a blocking part from being pressed out from the constriction of the contact tip. To this end, the blocking part has a contact surface that, in the blocking position of the blocking part, rests against an opposite contact surface of the socket. This contact surface can be disengaged from the opposite contact surface, whereby at least the section of the blocking part that has the contact surface is displaced in plug-in direction. Thereby the blocking part and thus also the locking extension can be displaced in the direction of the central longitudinal axis of the electrical socket. This displacement occurs preferably against the force of a spring-elastic element, which holds the blocking part in its blocking position if no external force acts on the blocking part.

The locking of the jack connector can advantageously be enabled by the same actuation unit with which locking of a socket-plugged first plug part, which is preferably constructed as an XLR plug, is enabled.

Advantageously, when inserting the jack connector, if the actuation unit is in its passive position, the contact tip of the jack connector contacts the locking extension, whereby a force component is exerted in the plug-in direction on the locking extension and thus also on the blocking part connected to it. The blocking part is thereby displaced in the plug-in direction and the contact surface of the blocking part is disengaged from the opposite contact surface of the electrical socket. Thereby, the locking extension can be pressed together with the blocking part from the pressed-in contact tip of the jack socket outwardly, i.e., away from the longitudinal axis and the jack connector can be completely inserted until the locking extension engages in the constriction of the contact tip.

Additional advantages and details pertaining to the invention are explained below using the attached drawing.

DESCRIPTION OF THE PREFERRED EMBODIMENTS

Figure 10:
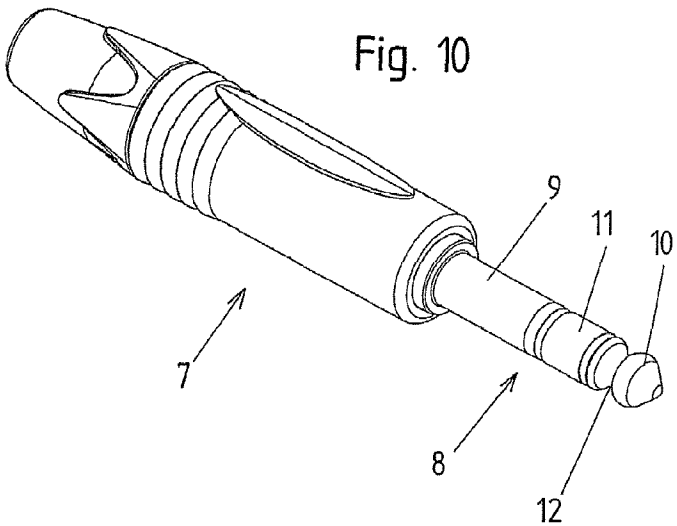
FIG. 9 and FIG. 10 depict a first and second plug that can be inserted into the electrical socket from an oblique view.
Figure 9:
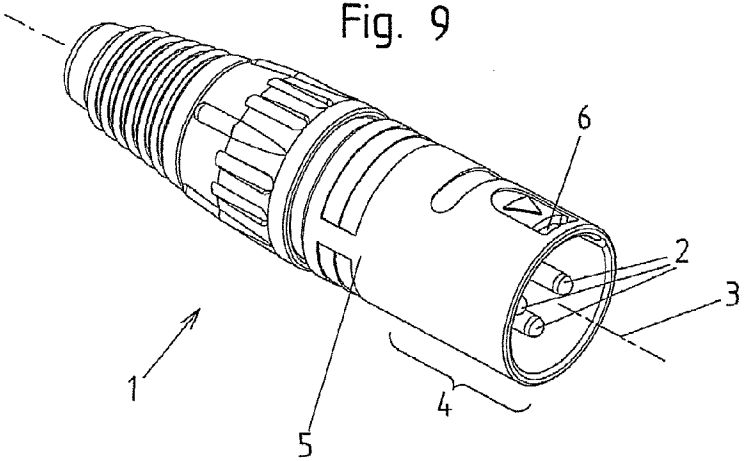

The drawings depict an embodiment of an electrical socket according to the invention. Such a socket can be mounted to a housing or a chassis of an electrical device. In these sockets, first and second plugs as they are depicted in FIGS. 9 and 10, can be inserted. In a plugged-in state of the first or second plugs, the electrical contact elements of the first or second plugs contact these interacting electrical contact elements of the socket to create the electrical connection.

The first plug 1 has on its plug-in side multiple plug pins 2 that form electrical contact elements of the first plug 1 and that are each arranged at a distance from the central longitudinal axis 3 of the first plug 1. A sleeve-shaped section 4 of the plug housing 5 surrounds these constituting plug pins 2. In this sleeve-shaped section 4 of the plug housing 5, a locking recession 6 is constructed that is constructed, in the depicted embodiment of the first plug 1, in the form of a window recess. A deepening, which forms the locking recession, could also be present on the interior side of the plug housing (5) facing the longitudinal axis 3.

The first plug depicted in FIG. 9 is an XLR-type plug. Such XLR plugs with various pin numbers are known, particularly those with three to seven pins.

The second plug depicted in FIG. 10 is a jack connector 7. Such a jack connector 7 has a plug shaft 8 that in any case comprises a contact sleeve 9 and a contact tip 10 that is electrically insulated from it, which form electrical contact elements of the jack connector 7. In the depicted embodiment, the jack connector 7 is constructed as a three-pin jack and between the contact sleeve 9 and the contact tip 10, a contact ring 11 is arranged that is electrically insulated both from the contact sleeve 9 and the contact tip 10 and that forms an additional electrical contact element of the jack connector 7. The contact tip 10, also referred to as a contact "bulb", has a circumferential groove or constriction 12, as is common in jack connectors, whereby an angular face connects to it at the deepest point of the constriction in the direction toward the male end of the contact tip 10. The plug-in end of the contact tip 10 is constructed conically, whereby an additional angular face is made.

The contact socket has on its plug-in side or front side a central plug-in opening 13 in which the plug shaft 8 of the jack connector 7 can be inserted in the plug-in direction 14, as well as plug-in openings 16, 17, 18 further away from the central longitudinal axis 15 for the plug pins 2 of the first plug 1, whereby the plug-in openings 16, 17, 18 connect directly to the central plug-in opening 13 and partially overlap with it, and also a ring-shaped plug-in opening 19 for section 4 of plug housing 5 of the first plug 1. The first plug 1 can be inserted in the plug-in direction 14 into the plug-in openings 16, 17, 18, and 19.

The plug-in openings 13, 16, 17, 18, 19 are constructed in a contact carrier 20, made of an electrically insulating material, of the electrical socket. In the depicted embodiment, this contact carrier 20 forms the housing of the socket. On the outside of the contact carrier 20 are constructed threaded flanges 21 with which the contact carrier 20 can be mounted on the chassis of an electrical device.

An additional, for example metal, housing could also be provided in which the contact carriers 20 are inserted.

On the contact carrier 20, there is an elastic locking arm 22 that has on its side facing away from the central longitudinal axis 15 of the socket a locking protrusion 23 with its one end being fixed. In the plugged-in state of the first plug 1, the locking protrusion 23 engages into the locking recession 6 in section 4 of the plug housing 5 and thereby secures the first plug 1 from being pulled out of the socket, cf. FIG. 11. In order to allow a snapping-in of the locking protrusion 23 into the locking recession 6 when inserting the first plug 1, the locking protrusion 23 has in a known manner a butting slant. The locking protrusion 23 is thus constructed in a tab-shaped manner.

Figure 3:
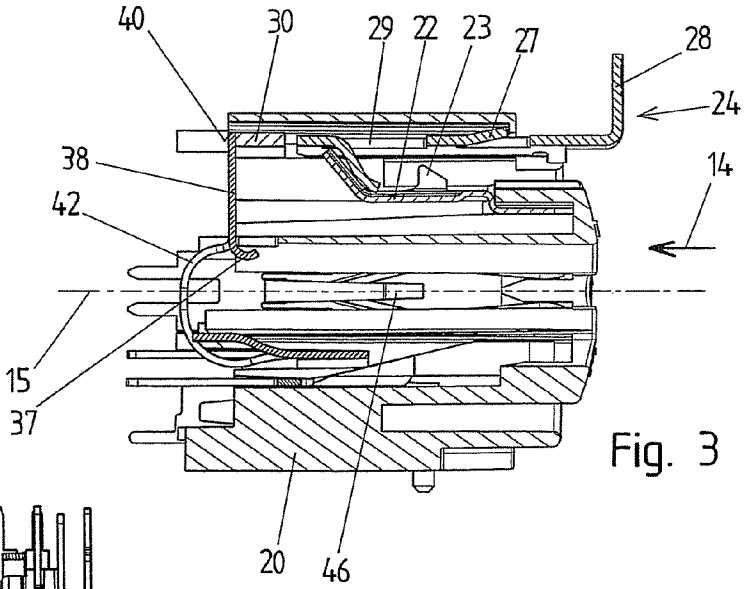
FIG. 3 and FIG. 4 depict cross sections along lines A-A and B-B from FIG. 1.
Figure 4:
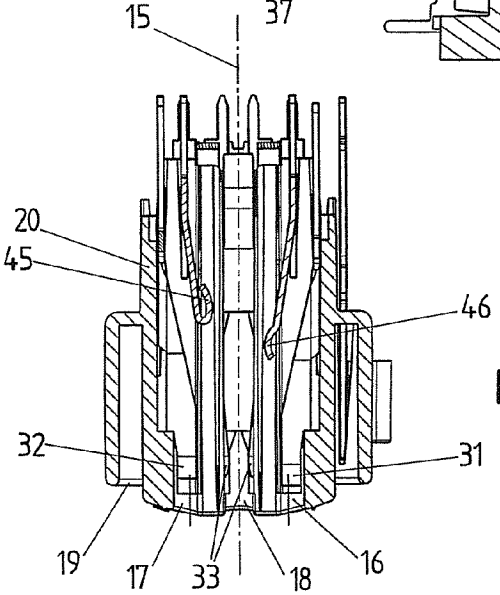
Figure 1:
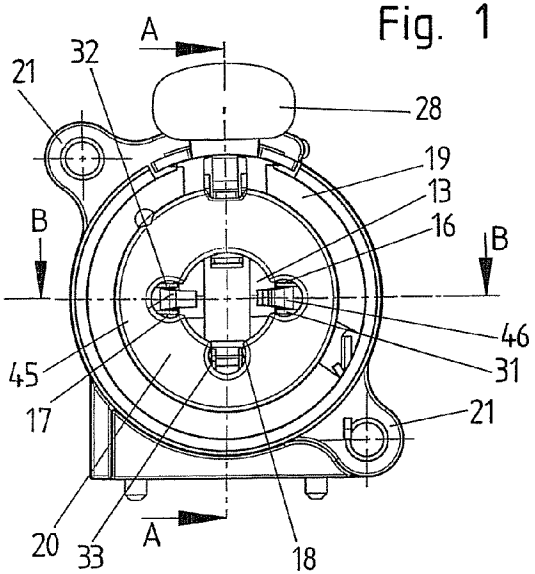
FIG. 1 depicts a frontal view of an embodiment of an electrical socket according to the invention.
Figure 2:
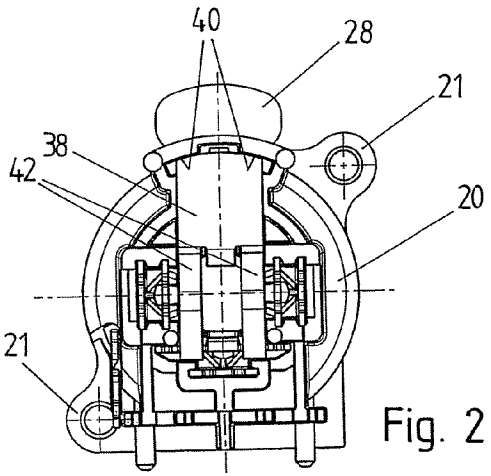
FIG. 2 depicts an electrical socket from the back.
Figures 5, 6, 7, 8:
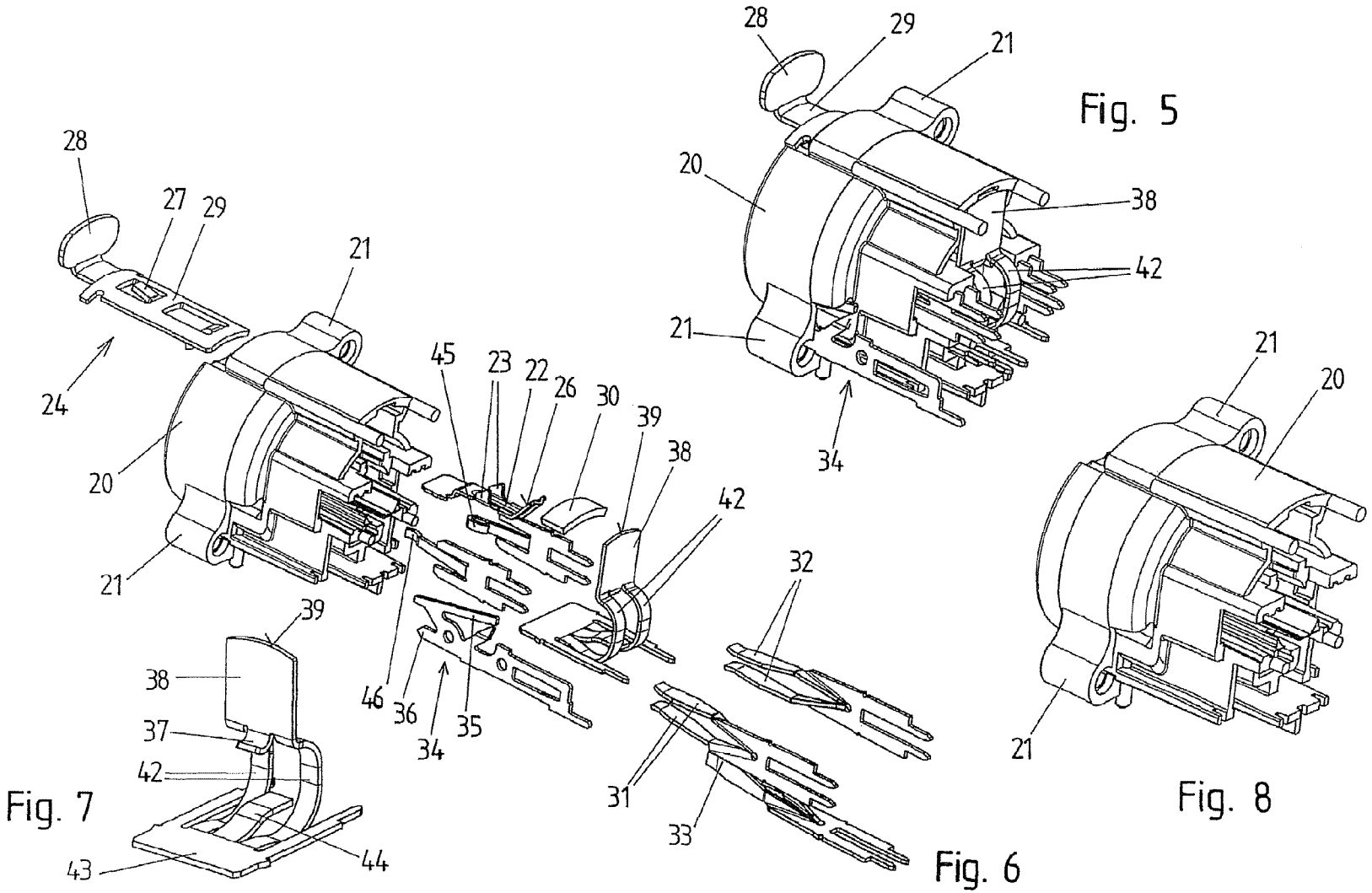
FIG. 5 depicts an oblique view of the electrical socket from the top rear.
FIG. 6 depicts a magnified oblique view of the electrical socket.
FIG. 7 depicts the locking extension and the insertion piece surrounding the blocking part from a different angle than that of FIG. 6.
FIG. 8 depicts the contact carrier without the elements inserted in it, from a top rear oblique view.
Figure 11:
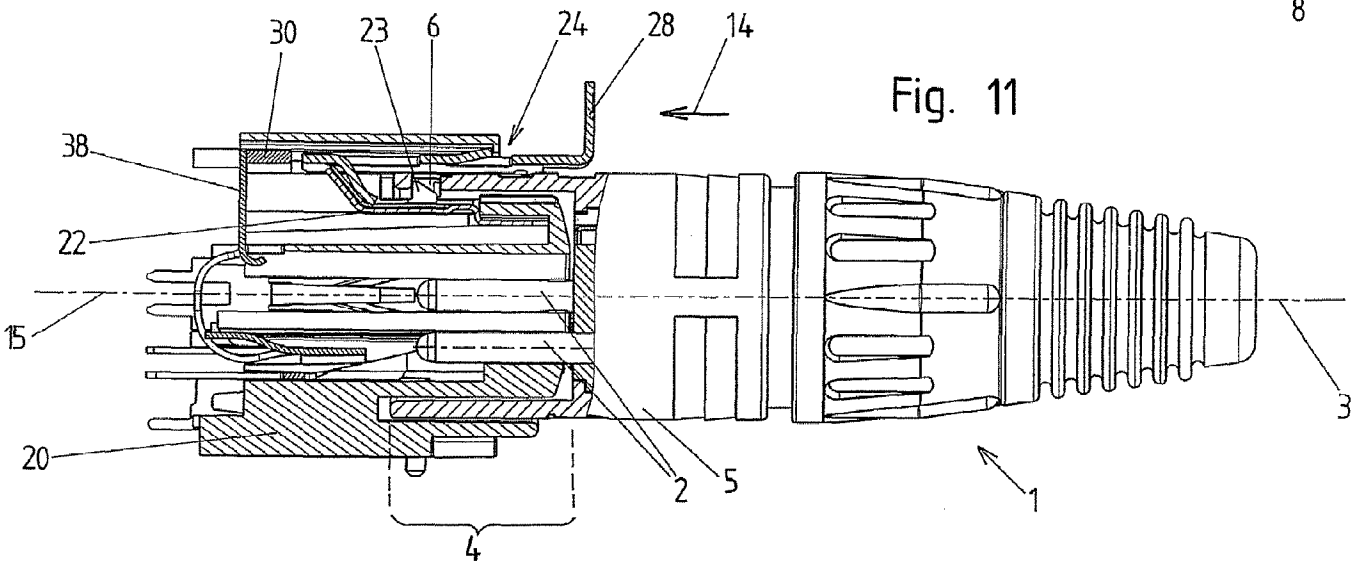
FIG. 11 depicts the first plug and the electrical socket in a connected state, partially exposed (along cross-sectional line A-A from FIG. 1).
Figures 12, 13, 14:
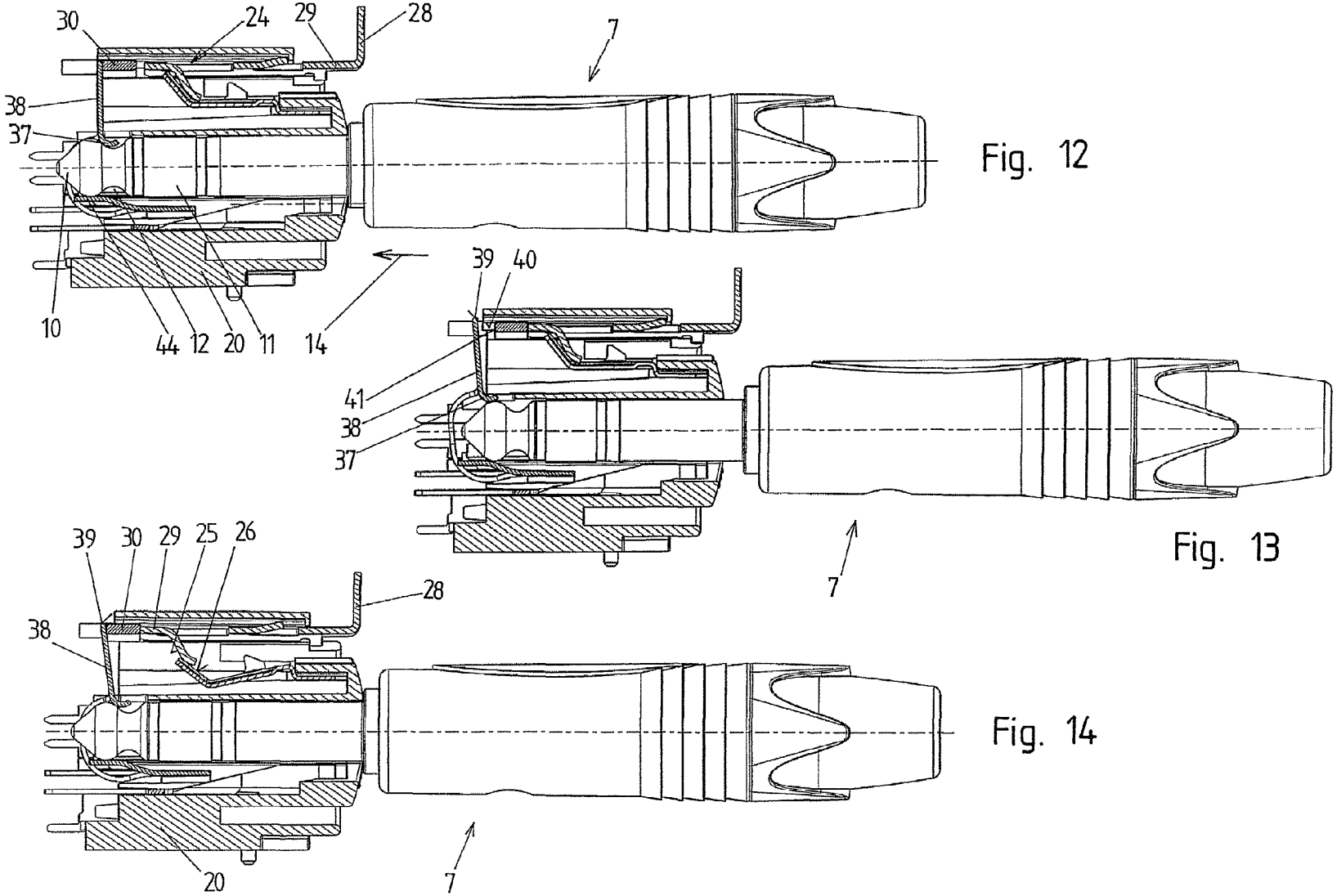
FIG. 12 depicts the second plug and the electrical socket in a connected state, whereby the second socket is depicted in the cross section A-A from FIG. 1.
FIG. 13 depicts a view corresponding to FIG. 12, but while plugging in the second plug.
FIG. 14 depicts a view corresponding to FIG. 12, but with the actuation unit in the active position.

In order to disengage the locking protrusion 23 from the locking recession 6 and to allow the first plug 1 to be pulled out from the socket, there is an actuation unit 24 that, based upon a passive position as depicted in FIGS. 3 and 11, is displaceable in the plug-in direction 14 until it reaches its active position depicted in FIG. 14. In displacing the actuation unit 24 from its passive position to its active position, an angular face 25 of the actuation unit 24, which interacts with an angular face 26 of the locking arm 22, displaces the locking protrusion 23 in a direction toward the central longitudinal axis 15, whereby the locking protrusion disengages from the locking recess 6.

If the actuation unit 24 is released again by the user, the spring-elastic locking arm 22 moves back to its starting position, whereby it also displaces the actuation unit 24 back into its passive position.

Instead of the interacting angular faces 25, 26, either only the locking arm 22 or the actuation unit 24 could have such an angular face and the other of these two parts could have a protrusion interacting with the angular face. There could also be a separate spring-elastic element that displaces the actuation unit back to its passive position if released by the user.

The locking arm 22 that is preferably made of metal extends, in the depicted embodiment, from its attachment point on the contact carrier 20 in a direction toward the back side of the socket. Instead, it could also extend in a direction toward the plug-in side of the socket.

Instead of a spring-elastic construction of the locking arm 22, it could also be positioned in a swivellable manner on the contact carrier 20 and be acted upon by a separate spring element to a position in which it engages into the locking recess 6 of the plugged-in first plug 1.

The actuation unit 24 is displaceably positioned in a recess of the contact carrier 20 so as to move between its passive and active position parallel to the plug-in direction 14. The actuation unit comprises a control part 28 that, in the depicted embodiment, is positioned at right angles to the longitudinal axis 15 of the socket, an actuating arm 29 connected to the control part 28, and a separate transfer part 30 (whose purpose is explained in greater detail below).

The actuation unit 24 positioned in its passive position is secured, in the depicted embodiment, against further displacement toward the plug-in direction 14 by a stop element 27 interacting with the contact carrier 20.

The electrical contact elements 31, 32, 33 to contact the plug pins 2 of the first plug 1 are borne by the contact carrier 20 and constructed, in the depicted embodiment, in the form of tuning fork contacts. These contact elements 31, 32, 33 are pushed into corresponding recesses of the contact carrier 20 from the back side and click into it.

Another electrical contact element 34 serves to contact section 4 of plug housing 5 by means of a contact guide 35. This contact element 34 is also pushed in from the back into a corresponding recess in the contact carrier 20 and snapped into it. A tip 36 of the contact element 34 serves to contact the chassis to which the contact sleeve is mounted.

The socket also comprises a locking device for a jack connector 7 plugged into the socket. This locking device comprises a locking extension 37 that, in the jack connector's plugged-in state, engages into the constriction 12 of contact tip 10. In the depicted embodiment, this locking extension 37 is constructed in a curved circular arc shape. In addition, the locking device for the jack connector 7 comprises a blocking part 38 that interacts with the locking extension 37 and is preferably rigidly, connected to it. In the depicted embodiment, the locking extension 37 and the blocking part 38 are constructed as one piece.

On the end pointing away from the locking extension 37, the blocking part has a contact surface 39. In the depicted embodiment, the blocking part 38 is constructed in a disk-shaped manner and the contact surface 39 is formed by the front-side edge of the disk-shaped blocking part 38.

When blocking part 38 is in a blocking position, as is depicted in FIGS. 3 and 12 for example, the contact surface 39 of the blocking part 38 lies against an opposite contact surface 40 of the socket. This opposite contact surface 40 points in a direction toward the central longitudinal axis 15 of the socket. Thus, given a blocking position of blocking part 38, an outward radial displacement, in relation to the longitudinal axis 15, of the blocking part 38 and thus also the locking extension 37 is not possible. Thus, in the event of a pull on the plugged-in jack connector 7 opposite the plug-in direction 14, the locking extension 37 of the angular face adjoining the deepest part of the constriction in the direction toward the female end of the contact tip 10 cannot be pushed out of the constriction 12 of the contact point 10 and the jack connector is locked in the socket. A displacement of blocking part 38 opposite the plug-in direction 14 is not possible due to its being braced by the contact carrier 20.

By a displacement in the plug-in direction 14 of at least the section of blocking part 38 that has the contact surface 39, the contact surface 39 disengages from the opposite contact surface 40 and the blocking part and thus the locking extension 37 are then, in relation to the position that the locking extension 37 and the blocking part 38 take when the locking extension 37 engages in the constriction 12 of the contact tip 10, moveable further away from the central longitudinal axis 15. Such a displacement of the blocking part 38 can then be effected by the actuation unit 24. If the actuation unit 24 is displaced from its passive position to its active position, its end 41 away from the plug-in side of the socket contacts the blocking part 38 and presses on its section adjoining the contact surface 39 in the plug-in direction 14 so that the contact surface 39 disengages from the opposite contact surface 40. All in all, in doing so, the blocking part 38 (and the locking extension 37) is swiveled in the depicted embodiment, and specifically about a contact point of the locking extension 37 at the contact tip 10. This condition is depicted in FIG. 14. Based on this condition, the locking extension 37 and the blocking part 38 can be displaced away from the central longitudinal axis 15. A force component directed away from the central longitudinal axis is generated by the angular face of the constriction 12 when pulling out the jack connector 7 from the socket, so that the locking extension 37 is pressed out of the constriction 12 in this manner.

In order to insert and lock the jack connector 7 into the socket, actuating the actuation unit 24 is not necessary. When inserting the jack connector 7, the angular face on the plug-in end of the contact tip 10 contacts the locking extension 37. This also causes a force component acting in the plug-in direction 14 to be exerted on the locking extension 37 and thus on the blocking part 38, whereby the blocking part is displaced in the plug-in direction 14 and its contact surface 39 disengages from the opposite contact surface 40. The radial outwardly acting force component can then move the locking extension 37 and the blocking part 38 in a direction away from the central longitudinal axis 15. FIG. 13 depicts the condition that the locking extension and the blocking part 38 take when the jack connector 7 is plugged in and the locking extension 37 just contacts the place of the largest diameter of the contact tip 10.

If no external force acts on the blocking part 38, then the blocking part 38 is held in its blocking position by a spring-elastic element 42. In the depicted embodiment, this spring-elastic element 42 is formed by a leaf spring that is bent in a no-load state. The one end of this bent leaf spring is hereby connected to the blocking part 38 and the other end of the bent leaf spring is connected to a support part 43. This support part 43 is borne by the contact carrier 20. Preferably, the support part 43 on this is inserted, from the back side of the socket, in a corresponding recess of the contact carrier 20 and snaps together with contact carrier 20.

Preferably, the blocking part 38, the spring-elastic element 42, and the support part 43 are rigidly connected to each other; in the depicted embodiment, these parts are constructed as one piece. Accordingly, the blocking part 38, the locking extension 37, the spring-elastic element 42 and the support part 43 form a metal component that is inserted in the contact carrier. The locking extension 37 accordingly constitutes an electric contact element for the electrical contacting of the contact tip 10 of the jack connector 7. In the depicted embodiment, there is an additional electrical contact element for contacting the contact tip 10 of the jack connector 7, and specifically in the form of a contact spring 44 extending from the support part 43. This contact spring rests against the side opposite the blocking part 38 of the contact tip 10 of the jack connector 7 and constitutes another part of the component.

Additional electrical contact elements 45, 46 to create electrical contacts with the plug shaft 8 and if applicable the contact sleeve 9 of the jack connector 7 are inserted in corresponding recessions of the contact carrier 20, preferably again from the rear side of the contact carrier 20.

All electrical contact elements of the contact sleeve lead through the rear side of the contact sleeve and have corresponding connection ends to create an electrical contact with an electric line or an electric conductive path of a circuit board.

In the depicted embodiment, the separate transfer part 30 also serves as insulation and thus consists of electrically insulating material, preferably plastic. If the transfer part 30 was constructed to conduct electricity, then upon actuating the actuating part 28, external interference, e.g., static charges, would reach the contact tip 10 of the jack connector directly and result in interference noise. The actuating arm 29 and the transfer part 30 could also be constructed as one piece. The electrical insulation between the actuating unit 24 and the locking device and contact tips 10 would then have to be designed differently.

As can be seen from the present description, the scope of the invention is not restricted to the depicted embodiments, but should be defined talking into consideration the enclosed claims together with their full range of possible equivalents. While the preceding description and the drawings portray the invention, it is apparent to persons skilled in the art that various modifications can be made to it without abandoning the true spirit and scope of the invention.

LEGEND

FOR THE REFERENCE NUMBERS

1 First plug
2 Plug pin
3 Longitudinal axis
4 Section
5 Plug housing
6 Locking recession
7 Jack connector
8 Plug shaft
9 Contact sleeve
10 Contact tip
11 Contact ring
12 Constriction
13 Central plug-in opening
14 Plug-in direction
15 Longitudinal axis
16 Plug-in opening
17 Plug-in opening
18 Plug-in opening
19 Ring-shaped plug-in opening
20 Contact carrier
21 Threaded flange
22 Locking arm
23 Locking protrusion
24 Actuation unit
25 Angular face
26 Angular face
27 Stop element
28 Control part
29 Actuating arm
30 Transfer part
31 Contact element
32 Contact element
33 Contact element
34 Contact element
35 Contact guide
36 Tip
37 Locking extension
38 Blocking part
39 Contact surface
40 Opposite contact surface
41 End
42 Spring-elastic element
43 Support part
44 Contact spring
45 Contact element
46 Contact element

The invention claimed is:

1. Electrical socket for alternatively creating an electrical plug-in connection with a first plug (1) that has on one plug-in end multiple plug pins (2) and, surrounding these, a sleeve-shaped section (4), or with a second plug constructed in the form of a jack connector (7) and having a plug shaft (8) with a contact sleeve (9) and a contact tip (10), whereby the first plug (1) and the jack connector (7) can be inserted in a plug-in direction (14), the socket comprising a locking arm (22) with a locking protrusion (23) that, in the plugged-in state of the first plug (1), engages in the locking recession (6) in the plug housing (5) of the first plug (10 to lock in the first plug (1), an actuating unit (24) that, from a passive position, can be displaced in the plug-in direction (14) to an active position and in the active position engages with the locking arm (22) and keeps the locking protrusion (23) disengaged from the locking recession (6) of the first plug (1), and a locking device for the jack connector (7) that comprises a locking extension (370 that engages, in the plugged-in state of the jack connector (7), in the constriction (12) of the contact tip (10) of the jack connector (7), and a blocking part (38) that has a contact surface (39) which rests against an opposite contact surface (40) of the socket when the blocking part (38) is in a blocking position, whereby the locking extension (37) in the blocking position of the blocking part (38) is held by the blocking part (38) engaged with the constriction (12) of the contact tip (10) of the jack connector (7) and is blocked from being pushed out of the constriction (12), and which can be brought to disengage from the opposite contact surface (40) by a displacement in the plug-in direction (14) of at least one of the sections of the blocking part (38) adjoining the contact surface (39), whereby a pushing out of the locking extension (37) from the constriction (12) of the contact tip (10) of the jack connector (7) is enabled, whereby the actuation unit (24) in its displacement from its passive position to its active position displaces in the plug-in direction at least a section of the blocking part (38) adjoining the contact surface (39) and disengages the contact surface (39) of the blocking part (38) from the opposite contact surface (40).

2. Socket according to claim 1, whereby for the electrical contacting of electrical contact elements of the plugged-in first plug (1) or the plugged-in jack connector (7), provided electrical contact elements (31, 32, 33, 45, 46) of the socket are borne by the socket's contact carrier made of an electrically insulating material.

3. Socket according to claim 2, whereby the actuation unit (24) is positioned in a recess of the contact carrier (20) in a displaceable manner parallel to the plug-in direction.

4. Socket according to, claim 1, whereby the contact surface (39) of the blocking part (38) is arranged on the end of the blocking part (38) pointing away from the locking extension (37).

5. Socket according to 4, claim 1, whereby the opposite contact surface (40) is formed by a socket surface oriented to the central longitudinal axis (15) of the socket.

6. Socket according to, claim 1, whereby the blocking part in its no-load state is held in its blocking position by a spring-elastic element (42).

7. Socket according to claim 6, whereby the spring-elastic element (42) is formed by a leaf spring.

8. Socket according to claim 7, whereby the leaf spring is curved in a no-load state.

9. Socket according to claim 7, whereby the one end of the spring-elastic element (42) is connected to the blocking part (38) and the other end of the spring-elastic element (42) is connected to a support part (43), which is borne by the contact carrier (20).

10. Socket according to claim 9, whereby a contact spring (44), used for the electrical contacting of the contact tip (10) of the jack connector (7) plugged into the socket, projects from the support part (43).

11. Socket according to claim 10, whereby the blocking part (38), the locking extension (37), the spring-elastic element (42) and the support part (43), are parts of a metal component that is inserted in the contact carrier (20).

12. Socket according to claim 11, whereby the contact spring (44) is also part of a metal component.

13. Socket according to claim 11, whereby the metal component is constructed as one piece.

14. Socket according to claim 2, whereby the blocking part (38), based on its blocking position, is secured from displacement opposite the plug-in direction (14) by the contact carrier (20).

15. Socket according to claim 5, whereby the opposite contact surface is arranged on the contact carrier (20).

* * * * *